US006464004B1

(12) United States Patent
Crawford et al.

(10) Patent No.: US 6,464,004 B1
(45) Date of Patent: Oct. 15, 2002

(54) RETRIEVABLE WELL MONITOR/ CONTROLLER SYSTEM

(76) Inventors: Mark S. Crawford, 5107 Gaystone La., Houston, TX (US) 77069; Phillip S. Sizer, 14127 Tanglewood Dr., Dallas, TX (US) 75234; Kerry D. Jermigan, 11407 Montverde, Houston, TX (US) 77099

( * ) Notice: Subject to any disclaimer, the term of this patent is extended or adjusted under 35 U.S.C. 154(b) by 0 days.

(21) Appl. No.: 09/131,008

(22) Filed: Aug. 7, 1998

Related U.S. Application Data

(63) Continuation-in-part of application No. 08/853,792, filed on May 9, 1997, now abandoned.

(51) Int. Cl.[7] ..... E21B 47/00
(52) U.S. Cl. ..... 166/250.01; 166/66; 166/66.6
(58) Field of Search ..... 166/250.01, 372, 166/66, 66.6; 340/853.9

(56) References Cited

U.S. PATENT DOCUMENTS 4,660,638 A * 4/1987 Yates, Jr. ..... 166/66
5,740,860 A * 4/1998 Crawford et al. ..... 166/64
5,803,167 A * 9/1998 Bussear et al. ..... 166/65.1

* cited by examiner

*Primary Examiner*—William Neuder
(74) *Attorney, Agent, or Firm*—Moser, Patterson & Sheridan, L.L.P.

(57) ABSTRACT

A well control and monitoring system which may be completely installed downhole and run into a cased well borehole or a production tubing string is disclosed. At least one mandrel having a side pocket instrument section having a downwardly facing entry and a wet connector or inductive coupler is placed in the well. A downhole digital processor and sensors are used to monitor tubing and casing fluid pressures and to control variable orifice valves or ESP pumps to control fluid flow to the production tubing from the casing/tubing annulus. The processor is progammable and reprogrammable in-situ.

22 Claims, 3 Drawing Sheets

RETRIEVABLE WELL MONITOR/ CONTROLLER SYSTEM

RELATED APPLICATIONS

This application is a continuation-in-part of U.S. application Ser. No. 08/853,792 filed May 9, 1997 now abandoned.

FIELD OF THE INVENTION

This invention is directed generally to well data monitoring and control systems for acquiring downhole well data such as pressure, temperature, fluid flow rate, etc. of the fluid that is located within a well and for controlling various downhole well operations, particularly operations concerned with production of fluid from the well and displaying such data or otherwise controlling the well in response to such data. More particularly, this invention concerns the provision of a mandrel(s) or tubing carried well tool holder run into a well on a tubing string and which is provided with a plurality of internal, bottom entry, instrument or tool side pockets which are electrically inter-connected for power/control purposes to thus enable electronic well data sensors, instrument electric power equipment, well controller instruments and the like to be installed and retrieved, such as by use of a wireline running tool run inside the tubing while the tubing string and mandrel remain undisturbed within the well. This invention also concerns bottom entry, multiple pocket, tubing installed, mandrel(s) that can be adapted for housing instruments for controlling gas-lift valves or the like and other artificial lift devises such as submersible pumps and which instrument can also be installed and retrieved by wireline operations.

Each of the possibly multiple side pockets of such mandrel(s) are equipped with electrical connection means enabling circuit completion upon installation of an instrument or other electronic interconnection of apparatus located within the various pockets of the mandrel(s). The present invention is also directed generally to electrically operable gas-lift valves which can be operated from surface located controls via an electric wireline extending from the surface to the downhole gas-lift valve mandrel(s) or which alternatively can be operated by a programmed on-board electronic controller and power system. The present invention is further directed to the acquisition of well data such as pressure, temperature, fluid flow, etc. and also such monitoring and acquisition equipment incorporating a remotely operable valve for changing valve positioning for gas-lift operations and a downhole controller processor that can be programmed or reprogrammed according to the production capability of the well.

Description of the Prior Art

When wells are drilled and completed for the production of petroleum products the hydrocarbon bearing subsurface formations being encountered, unless the formation has been produced by other wells, typically has sufficient formation pressure via natural gas pressure in the formation fluid to produce fluid from the well by forcing it from the subsurface zone to the well bore and thence upwardly from the formation depth to the surface through a production tubing string that is suspended within the well casing. After the well has been produced for a period of time, determined by the character, volume and other parameters of the subsurface oil bearing formation, the natural gas pressure or drive will diminish to the point that efficient hydrocarbon production will cease. To continue well production, other artificial lift production systems, such as pumps, gas-lift systems, waterflood systems and the like can be employed. When the decision is made to change the well completion for different well fluid production parameters, it is typically necessary to bring a work-over rig to the well site, pull the production tubing string from the well and replace it with a production tubing string of the character desired, i.e. pump, gas-lift, etc. Considerable well down time, work-over costs end equipment costs are routinely required for well work-over of this nature. It is desirable therefore to minimize the expense of a work-over rig and its personnel for converting wells from formation pressure induced oil production to production by gas-lift or other artificial lifting means.

It is known in the gas-lift oil production art to provide a production tubing string having a plurality of spaced gas-lift mandrels with a gas lift valve pocket in each of the mandrels. To temporarily isolate the interior of the valve pockets from casing annulus pressure and from the fluid that may be present therein, dummy valve elements may be inserted into the valve pockets to seal and protect the interior polished seal sections of the pocket and thereby to isolate the production tubing from the casing annulus pressure that is present at the gas inlet port of the valve pocket. One of the problems with the use of such dummy valves is that retrieval of a dummy valve by a retrieval tool leaves the valve pocket open and in unchecked fluid communication with the production tubing until such later time as a gas-lift valve is subsequently run through the tubing string and installed within the pocket. This unchecked fluid communication can result in sufficient gas pressure change or pressure drop to stop flow or kill the well so that other expensive and time consuming operations are required to restore the well to active production. It is desirable therefore to provide a well control system that can produce a well efficiently by means of natural formation pressure and which can be efficiently controlled in the downhole environment to produce the well by gas-lift or other artificial lift operations without risking potential killing of the well or damaging its productive capacity during the conversion process.

When a well is in reservoir pressure production or gas-lift production it is often desirable to acquire downhole well fluid parameter measurements on a reasonably continuous basis so that the well and others wells producing the formation can be produced in a manner that enhances the long term production of the formation. By monitoring production tubing pressure and/or casing annulus pressure at various well depths and by providing for a wide range of fluid flow or fluid production control, the production system for the well can be efficiently tuned for the precise flow parameters that achieve maximum long term production from the well and the field. For this reason and others, various types of downhole data sensors and recorders have been developed which are positionable within the sensor pocket of a downhole mandrel and are powered by a surface-to-sensor circuit as shown by U.S. Pat. No. 4,624,309 of Schnatzmeyer. Such sensors may also be monitored by an on-board, self contained programmable data recorder as shown in U.S. Pat. No. 5,130,705 of Allen et al. A retrievable electronic well data recorder is also shown by U.S. Pat. No. 5,327,971 of Garbutt et al.

Mechanically or electrically operated gas-lift valves that are variable in the downhole environment have generally not been available. For the most part, prior art gas-lift valves have only two positions, open or closed, whether they are mechanically or electrically operated. Adjustment of lift gas injection by electrically operated on/off valves has been achieved by controlling electrically operated valves from the surface, such adjustment being accomplished by adjusting the time sequence of valve operation. In the case of pressure responsive mechanical gas-lift valves, the rate of gas injection flow into the production tubing from the casing/tubing annulus of the valves is typically governed by the orifice dimension of each valve. To change the rate of gas flow it is typically necessary to retrieve the valve and adjust its flow rate by manually changing the orifice size. If the valve is of the pressure operated or responsive type, it is also necessary to change the charging pressure of the internal pressure chamber. It is desirable therefore, to provide an electrically operated gas-lift valve having a wide range of adjustable gas injection flow capability by orifice opening control and also having adjustable valve timing, both being adjustable in the downhole environment by programmable processor or from the surface via a surface control unit via wireline.

Electrically operated gas-lift valves have also been developed for controlling the injection of gas into a tubing string for well fluid production as shown by U.S. Pat. No. 2,658,460. Electrically operated gas-lift valves have been of rotary or poppet type, with both being solenoid energized and with the rotary type having a mechanism for converting the linear motion of a solenoid to achieve rotary motion of the valve element. In either case, the valves have been of the on/off type (i.e. fully open or closed) with the rate of gas injection form the well annulus being controlled only by timing the "on" (open) and "off" (closed) time cycles from a surface located controller, via an electric cable and by adjusting the timing sequence for valve operation. Electrically operated gas-lift valves having adjustable flow controlling orifices have more recently been developed, as shown by U.S. Pat. No. 5,176,164 of Boyle.

It is a principal feature of the present invention to provide a novel electrically operated system which is installed within the valve pocket of a gas-lift mandrel(s) having an electrical wet connection or an inductive coupler and which combines the features of an electrically operated gas-lift valve and a downhole well parameter monitor and data recorder in a single retrievable unit.

It is another feature of the present invention to provide a novel electrically operated system which may be installed within the valve pocket of a gas-lift mandrel having an electrical wet connection or an inductive coupler and which is operable either by an electrical power and control circuit extending to a surface located console or control computer, or by a downhole, battery powered, self contained, programmable and re-programmable processor.

It is an even further feature of the present invention to provide a novel electrically operated system which is installed within the valve pocket of a gas-lift mandrel(s) having an electrical wet connection or inductive coupler and which may be selectively retrieved for valve servicing or for downloading acquired well data to a surface computer for processing and subsequent well control use.

It is also a further feature of the present invention to provide an electrically operated retrievable unit having the on-board capability of acquiring downhole well data such as pressure, temperature, fluid flow, fluid viscosity, etc. and also incorporating an electrically operated valve for controlling valve orifice opening and flow rate for gas-lift operations and which can be operated by an electronic data processor/data memory system that can be programmed and reprogrammed according to the production capability of the well.

It is an even further feature of the present invention to provide a novel electrically operated system which may be installed within the valve pocket of a side pocket gas-lift mandrel(s) having an internal wet-connect type electrical connection or an inductive coupler and which provides the capability for sensing and recording downhole well data such as pressure, temperature, fluid flow, fluid viscosity, etc. and also incorporates an electrical mechanism for controlling valve orifice opening for well production control on gas-lift production operations and which is controlled by an electronic operation/data memory system that can be programmed or reprogrammed according to the production capability of the well.

SUMMARY OF THE INVENTION

Briefly, the various objects and features of the present invention are realized by the provision of a combination well flow control and well data acquisition system.

The system is run in the well on a production tubing string incorporating at least one or a plurality of longitudinally spaced side-pocket type mandrel(s) having internal side pockets electrically possibly and fluid pressure interconnected. A plurality of elongated retrievable electronic control and data acquisition instrument is provided. The control and data acquisition instruments are sized and adapted to fit within the respective internal pocket of the mandrel(s) and to be run on wireline inside production tubing using a kick over tool. The electronic circuits of the instruments have one or more wet-connect type electrical connectors or inductive type couplers for electrical wireline connection to the instruments. The instruments are provided with data sensing, transmittal and recording circuitry for acquiring various pressure and flow data. The system may also incorporate a remotely operable variable orifice valve mechanism for controlling entry of pressured gas from the casing/tubing annulus into the production tubing for lifting well fluid from the standing level within the well to the surface via the production tubing string. The variable orifice valve mechanism may be controlled via surface operated power and control circuitry, via wireline, or by battery powered on-board programmable and reprogrammable control circuitry for controlling injection of lift gas into the tubing string in accordance with the production capability of the well.

BRIEF DESCRIPTION OF THE DRAWINGS

So that the manner in which the above recited features and advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

DETAILED DESCRIPTION OF PREFERRED EMBODIMENT

Figures 1, 2:
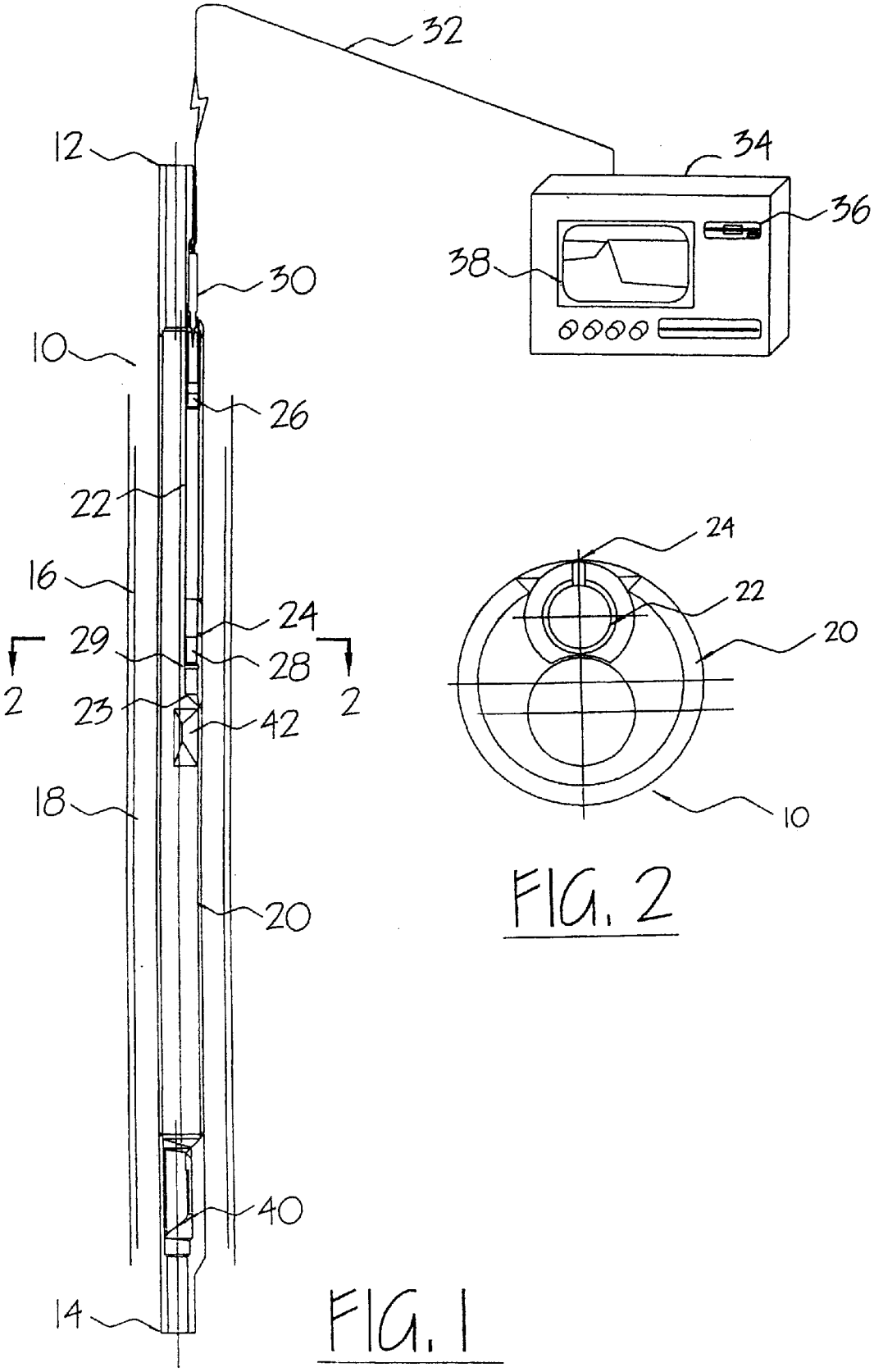
FIG. 1 is a schematic view of a side pocket mandrel disposed within a wellbore.
FIG. 2 is an enlarged top view of an instrument pocket disposed within the side pocket mandrel shown in FIG. 1.

Referring now to the drawings and first to FIG. 1, a side pocket mandrel is shown generally at 10, having upper and lower tubular ends 12 and 14 that are adapted for conventional connection to sections of production tubing that is suspended within a well casing, part of which being shown at 16. A side pocket mandrel of the type shown in U.S. Pat. No. 5,740,860 is suitable and this patent is incorporated by reference for all purposes. An annulus 18 is defined between the production tubing and mandrel and the well casing. In the event the well production system is designed for gas-lift production operations, gas is injected at the surface into the annulus at a pressure and flow rate that is suitable for gas-lift operations of that particular well. Within a side pocket section 20 of the mandrel there is provided an instrument pocket 22 (see FIG. 2) which may be isolated from the annulus if desired or may be in fluid and pressure communication with the annulus 18 via a port 24 at a location between internal seal sections 26 and 28 (FIG. 1) that are disposed at spaced locations within the instrument pocket. The instrument pocket 22 defines a downwardly facing pocket access opening 23 through which an instrument may pass as it is installed within or extracted from the pocket from inside tubing string. Since the pocket opening 23 faces downwardly there will be virtually no tendency for particulate and other debris entrained within the well fluid being produced to settle out within the pocket and foul the electrical connection or polished seal surfaces that are located therein. As shown in FIG. 1, the tubular pocket 22 is located at the upper end of the side pocket section so that an elongate tool 54, such as a data acquisition and control instrument, a gas-lift valve or the like, can be run through the tubing and oriented within the mandrel, below the instrument pocket, by a kick-over type installation tool 44 of FIG. 3 for upward insertion into the pocket 22. A suitable kickover tool is of the type shown in U.S. Pat. No. 4,976,314 which is incorporated by reference for all purposes. It should be borne in mind that alternatively the instrument pocket 22 may be located at a lower portion of the side pocket of the mandrel 10, if desired, so that the tool 54 or instrument may be oriented within the upper portion of the mandrel side pocket for downward insertion with the instrument pocket without departing from the true spirit and scope of this invention.

In the embodiment of the system of the invention shown in FIG. 1, the instrument pocket 22 of the mandrel 10 is shown to be provided at its upper end with a wet-connect type electrical connector 30 (as that in U.S. Pat. No. 5,740,860) with an electrical power and control wireline or cable 32. The electrical connector is sealed with respect to the tubing string 12 to the surface where it is electrically connected with a surface processor and real time readout console 34 having therein a data processing and control computer such as an Intel Pentium II processor and associated memory and I/O hardware, and a CRT display 38. In the alternative, the mandrel 10 of the tubing string may be provided with an internal power supply or a battery and programmable instrument control system. Data from the downhole acquisition and control system may be transmitted to data processing equipment 34 at the surface by any of a number of suitable telemetry systems. For example, data acquired and recorded by the instrument may be transmitted to the surface equipment by acoustic or sonic telemetry through the fluid column within the well. Systems are also contemplated wherein a downhole instrument portion may be periodically retrieved from its side pocket mandrel and brought to the surface where its recorded data downloaded to the surface computer (38 of FIG. 1) component of the data recovery, processing and display system of the surface located console 21. Additionally, the downhole mandrel of the tubing string may also be provided with a second, perhaps upwardly facing, pocket also having an internal electrical connector and being adapted to receive a monitor and control instrument having an on-board battery type power supply and being programmable with control functions to provide for control of other apparatus (electrically operable gas-lift valves or adjustable chokes, for example) with which the tubing string may be provided.

Figure 3:
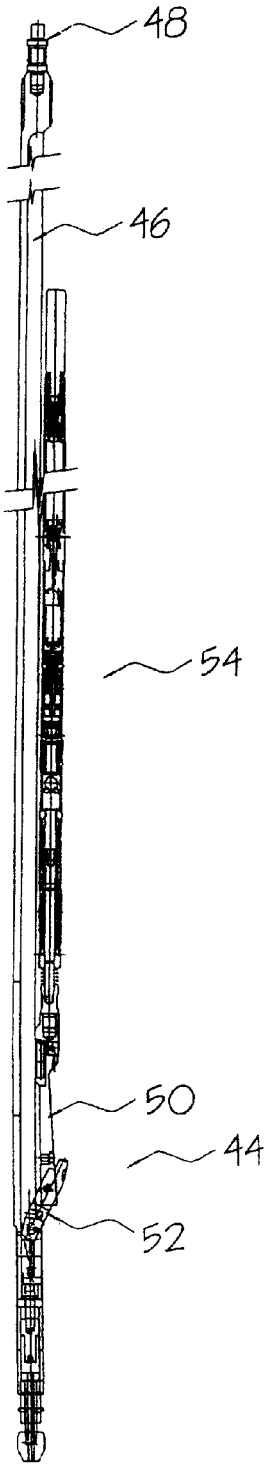
FIG. 3 is a sectional view of a kick-over tool.
Figure 4:
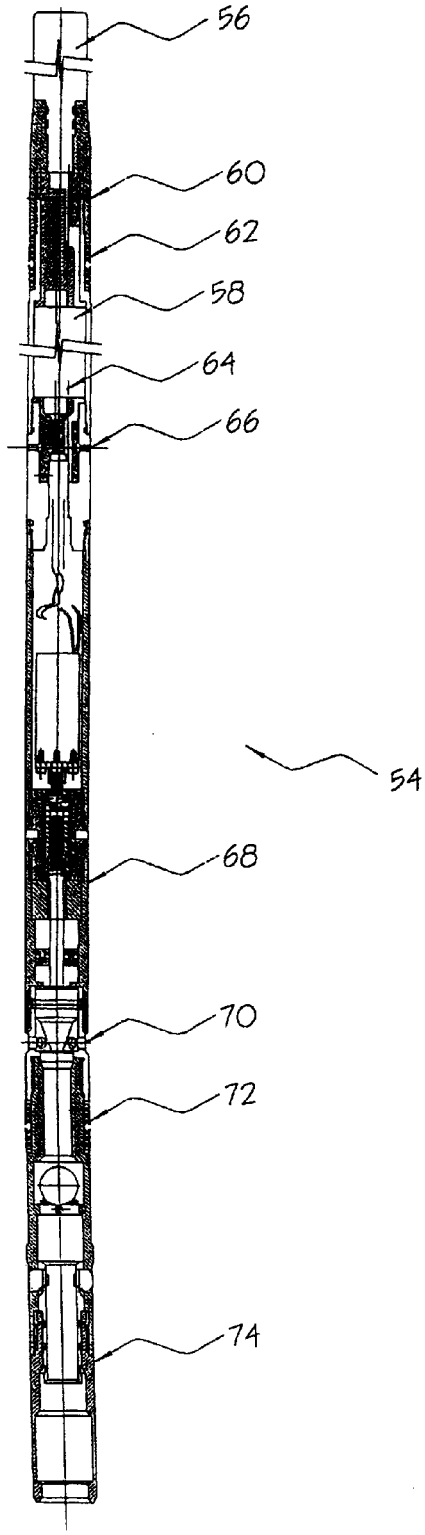
FIG. 4 is an enlarged, cross sectional view of the instrument shown in FIG. 3.

Within the side pocket mandrel running tool orienting elements 40 and 42 are located for contact by a kick-over type running and retrieving tool shown generally at 44 in FIG. 3. The kick-over tool 44 incorporates an elongate tool body 46 having a connection 48 at its upper end for connection with a wireline running system or any other suitable type of running system. At its lower end, the kick-over body is provided with a positioning arm assembly having upper and lower tool arms 50 and 52 which provide for running, support, and orientation of an elongate, generally tubular instrument shown generally at 54, the instrument 54 being shown in greater detail in FIG. 4. At its upper end, the instrument 54 is shown to be provided with a wet connect section 56 having the facility for establishing electrical connection with an opposite wet connect type electrical connection 30 that is provided within the instrument pocket 22 of the mandrel 10. Below the wet connect section 56 of the instrument is provided pressure and temperature monitoring or sensing device 58 having a sensing port 60 for fluid communication with the production tubing to enable the recording of well fluid data parameters within the tubing string at the location of the mandrel 10. The pressure and temperature sensor device 58 is separated by an upper seal or packer 62 from a second pressure and temperature monitor or sensor device 64 having a sensing port 66 for communication with well fluid in the annulus 18 (FIG. 1) at the well depth of the mandrel 10. The seal or packer 62 is engable with the internal polished seal section 26 of the instrument pocket 22 when the instrument 54 is fully seated within the instrument pocket.

The instrument also incorporates an electrically operated valve mechanism 68 having an injection gas port 70 which, when the instrument is fully inserted within the receptacle of the instrument pocket, is in communication with the injection gas port 24 (FIG. 1) to thus enable the valve mechanism 68 to receive injection gas from the annulus 18 and to control its flow into the tubing string 12 both from the standpoint of pressure and volume. Below the electrically operable valve mechanism 68, the instrument is provided with a lower seal or packing 72 which is disposed for sealing engagement with the lower internal seal section 28 (FIG. 1) of the pocket member 22. To enable the instrument 54 to be secured within the instrument pocket 22, the instrument is provided at its lower end with a positive latch mechanism 74 which may be latched with respect to the internal latch geometry 29 at the lower end of the instrument pocket 22.

To provide oil field producers with the capability of installing a tubing string in a well and completing the well for conventional reservoir pressure production and to also provide the producers with the capability of subsequently converting the tubing string to enable gas-lift production without requiring changing out the production tubing and replacing it with a gas-lift production tubing string according to the present invention the following method or process is followed: a production tubing string is run when the well is initially completed, with a plurality of mandrels such as the herein described mandrel 10 of FIG. 1, connected in spaced location along the length of the tubing string. Each of such mandrels incorporates a tool pocket that is designed for selective installation of a remotely operable gas-lift valve or a data acquisition and control instrument or instruments having both a data acquisition system and a gas-lift valve system or other artificial lift controller system such as a pump controller incorporated therein. Until the tubing string is converted for artificial lift operations the pockets of such side pocket mandrels will typically be isolated from the well casing from the standpoint of gas supply. If desired, the data acquisition instruments can be provided with seals or packings which can seal within the pocket in such manner as to confine casing pressure to the non-ported region of the instrument. If it is desired to continuously acquire casing pressure, temperature and other casing fluid parameters as well as acquiring tubing pressure, temperature and other fluid parameters, the instrument can have a sensor port that is exposed to casing pressure at the port 24. Data acquisition instruments may be placed within one or more of these tool pockets so that various well data, such as temperature, pressure, etc. of the well fluid within the tubing string may be continuously monitored and recorded. Also, the tool pockets may be provided with separate annulus ports, being isolated form those used by the gas-lift section of the mandrel, to enable a well fluid data acquisition system to also monitor and record downhole well data in the annulus of the well, with the well being in conventional reservoir pressure production.

After the well has been in production for a period of time, well conditions may have changed to the point that gas-lift or other artificial lift production becomes the production system of choice. Reconfiguration of the mandrels for gas-lift production can be as simple as retrieving the data acquisition and control instrument via wireline operations and replacing it with an instrument having both data acquisition and controllable gas-lift capability or controllable pump capability. Alternatively, the control program portion of the originally installed instrument may be reprogrammed in-situ by lowering a reprogramming instrument module. After conversion of the production system of the well in this manner, combination well data acquisition and gas-lift valve control or pump control instruments shown in FIG. 4 and FIG. 5 of drawings may be installed within the mandrel's tool pockets to thus provide for effective gas-lift or pump lift production of the well and to provide for acquisition of downhole well fluid data from the tubing string and the annulus and using such data to control the production fluid flow in response thereto.

Figure 5:
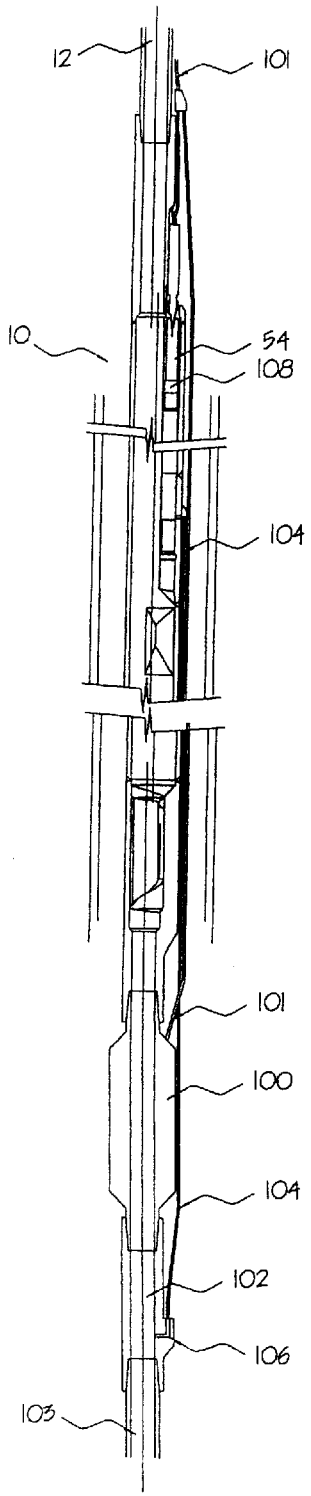
FIG. 5 is a schematic view of an electrical submersible pump.

Referring now to FIG. 5 of the drawings, a well data acquisition and control mandrel assembly shown generally at 10 and corresponding to the mandrel 10 of FIG. 1 may provided for a system using artificial lift by electrical submersible pump (ESP) by connecting below the mandrel a pump section 100 having an electrically powered submersible pump assembly. Pump assembly 100 is operated by electrical energy from a power cable 101 extending to the surface. The pump 100 intakes fluid from the tubing 103 below the mandrel 10 and positively displaces it toward the surface via tubing 12 above the mandrel 10. For sensing fluid pressure in tubing 103 below the subsurface ESP pump 100 and thus enabling determination of well conditions and changes in well conditions, a pup joint 102 is connected into the tubing string below the pump 100 and a pressure sensing tube 104 is connected at its lower end 106 to a pressure sensor located at the pup joint. This arrangement bypasses the pump section 100. Below the mandrel the lower end 106 of the sensing tube 104 is in fluid communication with the tubing interior via the pup joint and its upper end is in connection with a pressure gauge 108 as previously described. Thus, the pressure and flow data acquisition section of the instrument 54 also provides well pressure, temperature and other desirable well data from a location below the submersible pump 100 as well as above the pump 100 via mandrel 10. A second sensor tube may be provided, having its lower end connected to the ESP pump section and its upper end connected to the gauge circuitry 108 of the data acquisition instrument. The sensor tubes and their connection with the gauge circuitry, enable the downhole mandrel assembly to provide the data acquisition and ESP production functions discussed above and in addition enable the mandrel assembly 10 to also sense and hold well data from a location below. Such data could even be provided via a sampling tube unit located below a packer located below the mandrel 10 and pump assembly 100, if desired.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiments are, therefore, to be considered as merely illustrative and not restrictive, the scope of the invention being indicated by the claims rather than solely by the foregoing description, and all changes which come within the meaning and range of equivalence of the claims are therefore intended to be embraced therein.

What is claimed is:

1. A tubing carried, retrievable well monitor and control system for deployment in a cased well borehole, comprising:

at least one tubing carried, side pocket mandrel(s) capable of being run into a well bore on a production tubing string, said at least one mandrel(s) having a bore extending therethrough for connecting tubing above and below each such mandrel and having at least one downwardly facing side instrument pocket therein, said mandrel(s) being sized to fit inside well casing in the well, said downwardly facing side pocket(s) having controllably sealed fluid ports capable of communicating fluid pressure and flow to the interior thereof, and each such downwardly facing side pocket being electrically interconnected to each other such downwardly facing side pocket; and at least one wireline retrievable, through tubing sized, instrument installed in at least one of such mandrel(s), said instrument having at least one means for monitoring tubing fluid pressures and casing/tubing annulus fluid pressure and means for controlling fluid flow from the casing/tubing annulus into the production tubing string in response to said tubing fluid pressures and casing/tubing annulus fluid pressure and means for transmitting such pressure measurement data to the surface of the earth from the mandrel(s).

2. The system of claim 1 employing a plurality of such mandrels carried by the tubing in a spaced apart relation.

3. The system of claim 1 wherein said at least one wireline retrievable instrument comprises an instrument sized and adapted to be run through tubing to said at least one mandrel and installed in said side pocket using a kick over tool.

4. The system of claim 1 wherein said side pockets have an electrical wet connector for electrically contacting said installed instrument.

5. The system of claim 1 wherein said side pockets have at least one inductively coupled connector.

6. The system of claim 4 wherein said electrical wet connector interconnects said retrievable instrument and any other such instruments installed in any other such mandrel side pockets.

7. The system of claim 5 wherein said means for transmitting measurement data to the surface of the earth includes an electrical wireline carried by said production tubing string.

8. The system of claim 7 and further including a surface control and display processor capable of two way communication with said at least one retrievable instrument via said electrical wireline.

9. The system of claim 8 wherein said means for controlling fluid flow from the casing/tubing annulus into the production tubing string comprises an electrically controllable variable orifice gas lift valve.

10. The well control and monitor system of claim 9 and further including:

means for opening said controllably sealed fluid ports, said ports being initially in their closed position, said opened fluid ports communicating fluid pressure and flow from the casing/tubing annulus into the tubing.

11. The system of claim 1 wherein said means for controlling fluid flow comprises a programmable digital downhole processor.

12. The system of claim 11 wherein said programmable downhole processor is reprogrammable downhole in-situ.

13. The system of claim 12 wherein all of the control functions are performed by said programmable downhole processor.

14. A method for monitoring and controlling fluid flow from a casing/tubing annulus in a cased wellbore into a production tubing in the wellbore in a producing well comprising the steps of:

running into a cased wellbore on a production tubing string, at least one mandrel section and placing said mandrel section in an interval to be monitored and controlled;

installing in a downwardly facing side pocket instrument section in said mandrel at least one monitor and control instrument being capable of monitoring casing and tubing pressure data and controlling fluid flow from the casing/tubing annulus and means for two way communication of such data and control functions from said mandrel to the surface of the earth.

15. The method of claim 14 wherein the monitor and control functions are performed by a downhole digital processor.

16. The method of claim 15 wherein downhole digital processor is reprogrammable in-situ in the well borehole.

17. The method of claim 14 wherein the step of installing said monitor and control instrument into said side pocket is performed through the production tubing string using a kick over tool.

18. The method of claim 17 wherein any instrument sized and adapted for passage through the production tubing may be installed or retrieved from downhole side pocket by mandrels use of said kick over tool.

19. The method of claim 14 wherein said two way communication means includes an electric wire line carried by said production tubing string.

20. A tubing carried, retrievable well monitor and control system for deployment in a cased well borehole, comprising:

at least one tubing carried, side pocket mandrel(s) capable of being run into a well bore on a production tubing string, said at least one mandrel(s) having a bore extending therethrough for connecting tubing above and below each such mandrel and having at least one side instrument pocket therein, said mandrel(s) being sized to fit inside well casing in the well, said side pocket(s) having controllably sealed fluid ports capable of communicating fluid pressure and flow to the interior thereof, and each such side pocket being electrically interconnected to each other such side pocket; and at least one wireline retrievable, through tubing sized, instrument installed in at least one of such mandrel(s), said instrument having at least one means for monitoring tubing fluid pressures and casing/tubing annulus fluid pressure and means for controlling fluid flow from the casing/tubing annulus into the production tubing string in response to said tubing fluid pressures and casing/tubing annulus fluid pressure, said means for controlling fluid flow comprises a programmable downhole processor which is reprogrammable downhole in-situ, and means for transmitting such pressure measurement data to the surface of the earth from the mandrel(s).

21. The system of claim 20 wherein all of the control functions are performed by said programmable downhole processor.

22. A method for monitoring and controlling fluid flow from a casing/tubing annulus in a cased wellbore into a production tubing in the wellbore in a producing well comprising the steps of:

running into a cased wellbore on a production tubing string, at least one mandrel section and placing said mandrel section in an interval to be monitored and controlled;

installing in a side pocket instrument section in said mandrel at least one monitor and control instrument being capable of monitoring casing and tubing pressure data and controlling fluid flow from the casing/tubing annulus, wherein the monitor and control functions are performed by a downhole digital processor which is reprogrammable in-situ in the well borehole, and means for two way communication of such data and control functions from said mandrel to the surface of the earth.

* * * * *